US009538827B2

(12) United States Patent
Burton

(10) Patent No.: US 9,538,827 B2
(45) Date of Patent: Jan. 10, 2017

(54) PORTABLE SINGLE-USE SUNSCREEN CONTAINER WITH INTEGRATED APPLICATOR

(71) Applicant: Session Savers Sunscreen LLC, San Diego, CA (US)

(72) Inventor: John David Burton, San Diego, CA (US)

(73) Assignee: Session Savers Sunscreen LLC, Charlotte, NC (US)

( * ) Notice: Subject to any disclaimer, the term of this patent is extended or adjusted under 35 U.S.C. 154(b) by 304 days.

(21) Appl. No.: 13/965,817

(22) Filed: Aug. 13, 2013

(65) Prior Publication Data

US 2014/0064818 A1 Mar. 6, 2014

Related U.S. Application Data

(60) Provisional application No. 61/693,883, filed on Aug. 28, 2012.

(51) Int. Cl.

| | |
|---|---|
| ***A45D 40/26*** | (2006.01) |
| ***A45D 34/00*** | (2006.01) |
| ***A45D 34/04*** | (2006.01) |
| ***A45D 37/00*** | (2006.01) |
| ***A45D 40/00*** | (2006.01) |

(52) U.S. Cl.

CPC ..... *A45D 40/26* (2013.01); *A45D 34/00* (2013.01); *A45D 34/04* (2013.01); *A45D 37/00* (2013.01); *A45D 40/0087* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,189,227 | A * | 6/1965 | Hobbs | B65D 75/40 206/820 |
| 3,224,640 | A * | 12/1965 | Schneider | B65D 31/12 222/107 |
| 5,851,071 | A * | 12/1998 | Arnell | B65D 33/2533 383/209 |
| 5,944,437 | A | 8/1999 | Heller | |
| 6,054,120 | A | 4/2000 | Burgoyne et al. | |
| 6,348,246 | B1 * | 2/2002 | Finestone | B32B 27/10 206/524.2 |

(Continued)

*Primary Examiner* — David Walczak
(74) *Attorney, Agent, or Firm* — Genius Patent APC; Bruce Hare

(57) ABSTRACT

A lotion container includes a sealed outer edge that defines a cavity adapted to store an amount of lotion sufficient for a single application; and a set of notches that define a removable section of the lotion container, wherein at least one notch from the set of notches severs a portion of the sealed edge such that the lotion is able to be dispensed from the cavity if the removable section is separated from the lotion container. A container adapted to store and dispense lotion includes a cavity adapted to store lotion sufficient for a single application; an integrated applicator spout extending out from the cavity; and a removable section adapted to allow stored lotion to be dispensed through the applicator spout. A lotion kit includes multiple single-use lotion containers; and a fastener adapted to be coupled to one or more of the single-use lotion containers.

12 Claims, 4 Drawing Sheets

(56) References Cited

U.S. PATENT DOCUMENTS

| | | | | |
|---|---|---|---|---|
| 6,557,731 | B1 * | 5/2003 | Lyon | B65D 75/5811 222/107 |
| 7,004,322 | B1 * | 2/2006 | Bartoli | B65D 75/5811 206/484 |
| 8,556,636 | B2 * | 10/2013 | Feit | G09F 5/042 434/395 |
| 9,260,231 | B2 * | 2/2016 | Havrileck | B65D 75/325 |

* cited by examiner

PORTABLE SINGLE-USE SUNSCREEN CONTAINER WITH INTEGRATED APPLICATOR

CROSS-REFERENCE TO RELATED APPLICATIONS

This application claims priority to U.S. Provisional Patent Application Ser. No. 61/693,883, filed on Aug. 28, 2012.

BACKGROUND OF THE INVENTION

The use of sun protectant products (e.g., lotions, sprays, etc.) is ubiquitous. Such products are typically sold in relatively large containers, such as tubes and bottles and may have a length of about six inches or more. Such containers are intended to provide the user with an amount of lotion sufficient for many applications over a period of time. However, because of the relatively large size of such containers, they are inconvenient to transport on one's person, or store in a personal bag such as a purse.

A common problem is for a sunscreen user to arrive at a beach ready to swim, surf or otherwise enjoy the water, and realize that he or she has forgotten to bring sun protectant. Once at the beach in swimwear, it may be inconvenient for the user to leave to go get sun protectant.

A similar problem may arise for an athlete such as a golfer who begins playing a round of golf (or tennis match, basketball game, etc.) when the weather is overcast, and thus did not apply sun protectant and may not have convenient access to a conventional container of sun protectant. However, after playing many holes, the weather may change to bright sun, and the golfer may wish to apply sun protectant, but walking all the way back to the clubhouse is not practical as it would delay play for other golfers.

Another example of a similar problem is a user who begins skiing early in the day when the sun is not bright. However, if weather conditions change and the sun is now shining brightly, the user may desire sun protectant. The user may find it inconvenient to walk all the way back to the ski lodge and remove skis and other equipment to go inside to obtain sun protectant.

An example of another similar problem is a parent (or caretaker) who has spent significant time preparing young children for a walk in the neighborhood. When the parent begins the walk with the children the sun may not be shining, however, after walking a significant distance from home the sun may begin to shine brightly, creating a need for sun protectant for the parent and the children. At this point, it may be inconvenient for the parent to walk all the way back home to get sun protectant. In addition, during the time it may take to walk home (or return to the clubhouse, locker room, etc.) the users may be exposed to the sun without protection.

Thus there is a need for an individually packaged, single-use sun protectant container with an integrated applicator that is able to be easily carried on one's person or in a personal bag at all times.

BRIEF SUMMARY OF THE INVENTION

Some embodiments of the present invention provide a container for lotions. Each container may include an amount of lotion that appropriate for a specific use (e.g., for covering the typically exposed areas of an adult user, for applying to the typically exposed areas of a parent and child, for covering the typically exposed areas of an adult couple, etc.). Different embodiments may include different amounts of lotion. Each container may be sized, shaped, and/or otherwise configured such that the container may be easily carried by a user (e.g., in clothing pockets, in a purse or handbag, etc.).

Some embodiments may include a through-hole that may be adapted to accept a fastening element such as a lanyard, chain, clip, and/or other appropriate element to allow the container to be fastened to another object (e.g., clothing, a bag, sporting equipment, key chain, tackle box, etc.). Some embodiments may include a fastening element appropriate for use with the through-hole (e.g., a three to four inch length of ball chain with clasp, a carabiner clip, etc.).

The container of some embodiments may include an opening feature (e.g., a tab or other such feature that may be grasped and held by a user) formed by a removable (or partially removable) section. Such an opening tab may include an area around the through-hole and may be defined by a set of notched sections formed in the container. In some embodiments, with the opening feature detached (or partially detached) from the rest of the container, an integrated applicator spout may be exposed.

Some embodiments may provide a set of containers (e.g., a ten-pack set of containers, a twenty-pack set of containers, etc.) in a single package. Such a package may include multiple containers, and one or more fastening elements. In addition, the package (and/or each individual container) may include product information (e.g., sun protection factor (SPF) rating, directions for use, a list of active ingredients, a list of inactive ingredients, warnings, brand information, graphic art features, etc.).

In a first exemplary embodiment of the invention, a lotion container includes: a sealed outer edge that defines a cavity adapted to store an amount of lotion sufficient for a single application; and a set of notches that define a removable section of the lotion container, where at least one notch from the set of notches severs a portion of the sealed edge such that the lotion is able to be dispensed from the cavity if the removable section is separated from the lotion container.

In a second exemplary embodiment of the invention, a container adapted to store and dispense lotion includes: a cavity adapted to store an amount of lotion sufficient for a single application; an integrated applicator spout extending out from the cavity; and a removable section adapted to allow stored lotion to be dispensed through the applicator spout if the removable section is separated from the container.

In a third exemplary embodiment of the invention, a lotion kit includes: multiple single-use lotion containers; and a fastener adapted to be coupled to one or more of the single-use lotion containers.

The preceding Summary is intended to serve as a brief introduction to various features of some exemplary embodiments of the invention. Other features (and/or combinations of features) may be embodied in other specific forms without departing from the spirit of the invention.

BRIEF DESCRIPTION OF THE SEVERAL VIEWS OF THE DRAWINGS

The novel features of the invention are set forth in the appended claims. However, for purpose of explanation, several embodiments of the invention are set forth in the following drawings.

DETAILED DESCRIPTION OF THE INVENTION

The following detailed description is of the best currently contemplated modes of carrying out exemplary embodiments of the invention. Various inventive features are described below that can each be used independently of one another or in combination with other features. The description is not to be taken in a limiting sense, but is made merely for the purpose of illustrating the general principles of the invention, as the scope of the invention is best defined by the appended claims.

Broadly, embodiments of the present invention generally provide a portable single-use container with an integrated applicator. Such a container may be used to store and apply lotion. Such lotion may provide sun screen or sun block protection. Although various examples below may refer to specific shapes, sizes, features, etc. associated with some embodiments, one of ordinary skill in the art will recognize that various different specific shapes, sizes, features, etc. may be associated with some embodiments.

The term "lotion", as used herein, may refer to any type of material (or combination of materials) that may be applied to a user's skin (e.g., lotions, gels, oils, creams, ointments, etc.). Such lotions may be associated with sun protection (e.g., sun screen, sun block, etc.) and/or other appropriate purposes (e.g., moisturizing, treatment of various conditions, etc.). In addition, the term "sun protectant" (or similar terms), as used herein may refer to any type of lotion (e.g., lotions without sun protection).

Figure 1:
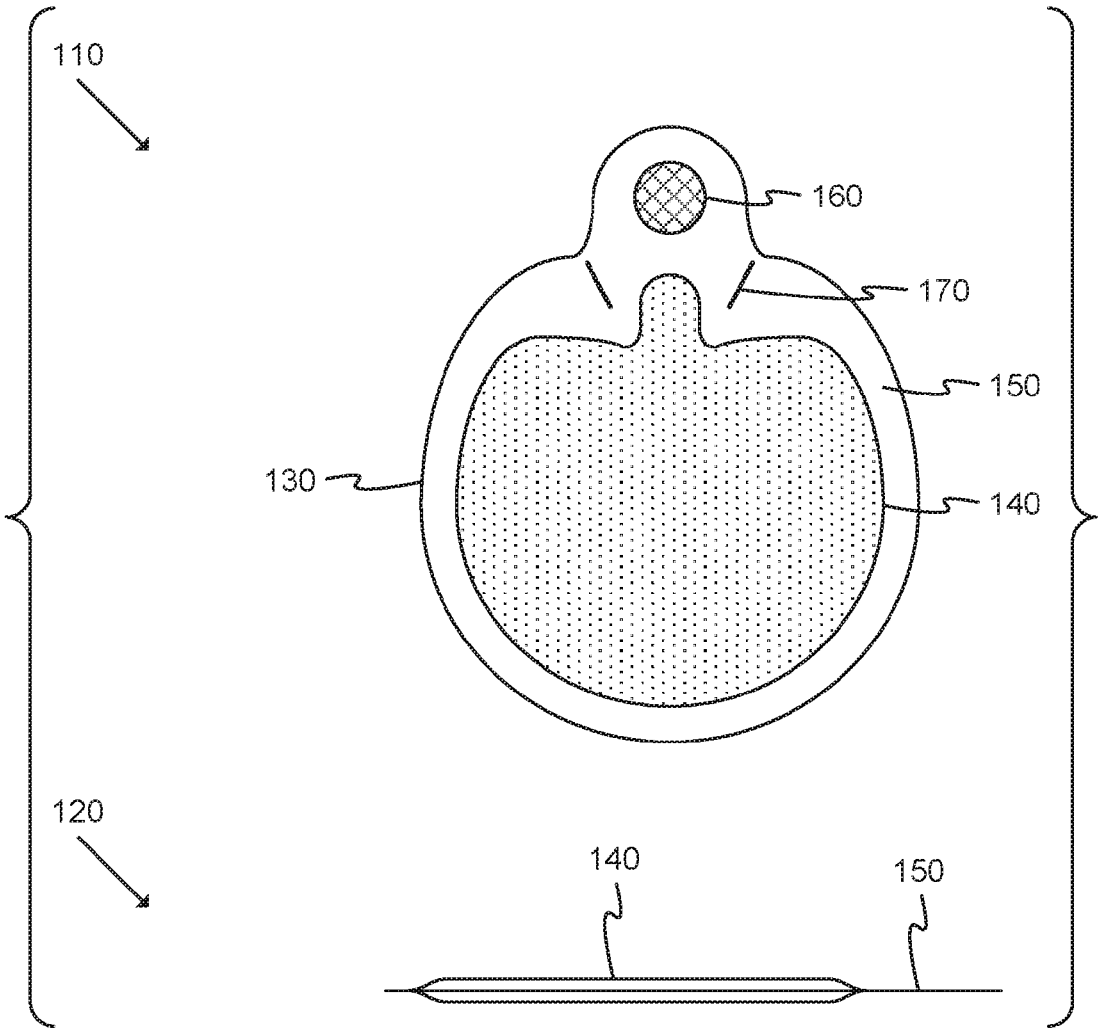
FIG. 1 illustrates a front view and a side view of a container according to an exemplary embodiment of the invention.

FIG. 1 illustrates a front view 110 and a side view 120 of a container 130 according to an exemplary embodiment of the invention. Specifically, this figure shows the various features included in some embodiments of the container. As shown, the container 130 may include a cavity 140 adapted to store lotion, a sealed edge 150, a fastener receptacle 160, and a set of notches 170 that may define a removable (or partially removable) section of the container 130 that forms an opening and application feature.

The container may be made of various appropriate materials (e.g., foils, plastic, paper, laminates, etc.). The container may be formed by joining similarly-shaped front and back elements. The container may have a round shape and may be sized with an appropriate diameter (e.g., two and one-half inches, sixty-nine millimeters, etc.) and having a cavity 140 with an appropriate volume (e.g., 1.3 ml, 1.5 ml, etc.).

The sealed edge 150 may be formed in various appropriate ways (e.g., using adhesives, application of pressure, application of heat, and/or other appropriate operations). The sealed edge may define the shape of the cavity 140. Different embodiments may include different sizes and shapes of cavities, as appropriate.

The fastener receptacle 160 may be a through-hole having an appropriate shape (e.g., ellipse, triangle, rectangle, octagon, etc.) and size (e.g., a diameter of one-fourth inch, a side length of one-eighth inch, etc.). The receptacle may be sized for an included ball chain and clasp fastener (not shown) and/or other appropriate fasteners (e.g., clips, cords, chains, hooks, etc.).

The notches 170 may be formed in various appropriate ways (e.g., application of pressure to the container at specific locations, by forming cuts, scores, and/or perforations along sections of the sealed edge 150 (and/or other sections of the container 130), etc.).

The notches 170 may define a removable (or partially removable) area of the container. For instance, a user may able to grasp the area around the fastener receptacle 160 and pull the area away from the cavity 140. The sealed edge 150 of the container may thus be partially severed to create an opening and expose the lotion within the cavity 140. In some cases, the removable area may be completely removed from the body of the container 130. Alternatively, the removable area may be only partially removed such that an opening is formed but the removable area is not completely detached from the body of the container.

Example container 130 includes a removable area that extends out from the body of the container 130 to form an opening tab. Other embodiments may include various different types, shapes, sizes, etc. of removable area. For instance, the alternative example container described below in reference to FIG. 3 includes a removable area that is integrated into the body of the alternative container.

In some embodiments, an integrated applicator may facilitate removal of lotion from the cavity (one such integrated application will be described below in reference to FIG. 2).

During use, a user may first attach the container 130 to an appropriate location such as a backpack or clothing (or place the container in an appropriate location such as a bag or pocket). When the contents are needed, the user may then retrieve the container 130, open the container by removing the opening tab formed by the notches 170 to expose the contents, and then retrieve the contents by applying pressure to the outer surfaces of the container 130 such that the contents are forced out the opening formed by removing (or partially removing) the opening tab. The user may then apply the contents and dispose of the used container.

Although the container of FIG. 1 has been described with reference to various specific details, one of ordinary skill in the art will recognize that different embodiments may be implemented in various different ways with various different specific details without departing from the spirit of the invention. In addition, the elements shown in FIG. 1 are conceptual in nature and not meant to convey specific dimensions, relative dimensions, shapes, sizes, etc. For instance, although some containers may have a generally round shape from a front view, other containers may be shaped in various other ways (e.g., having a generally rectangular shape, having an irregular shape, etc.). Another example container will be described below in reference to FIG. 3.

Figure 2:
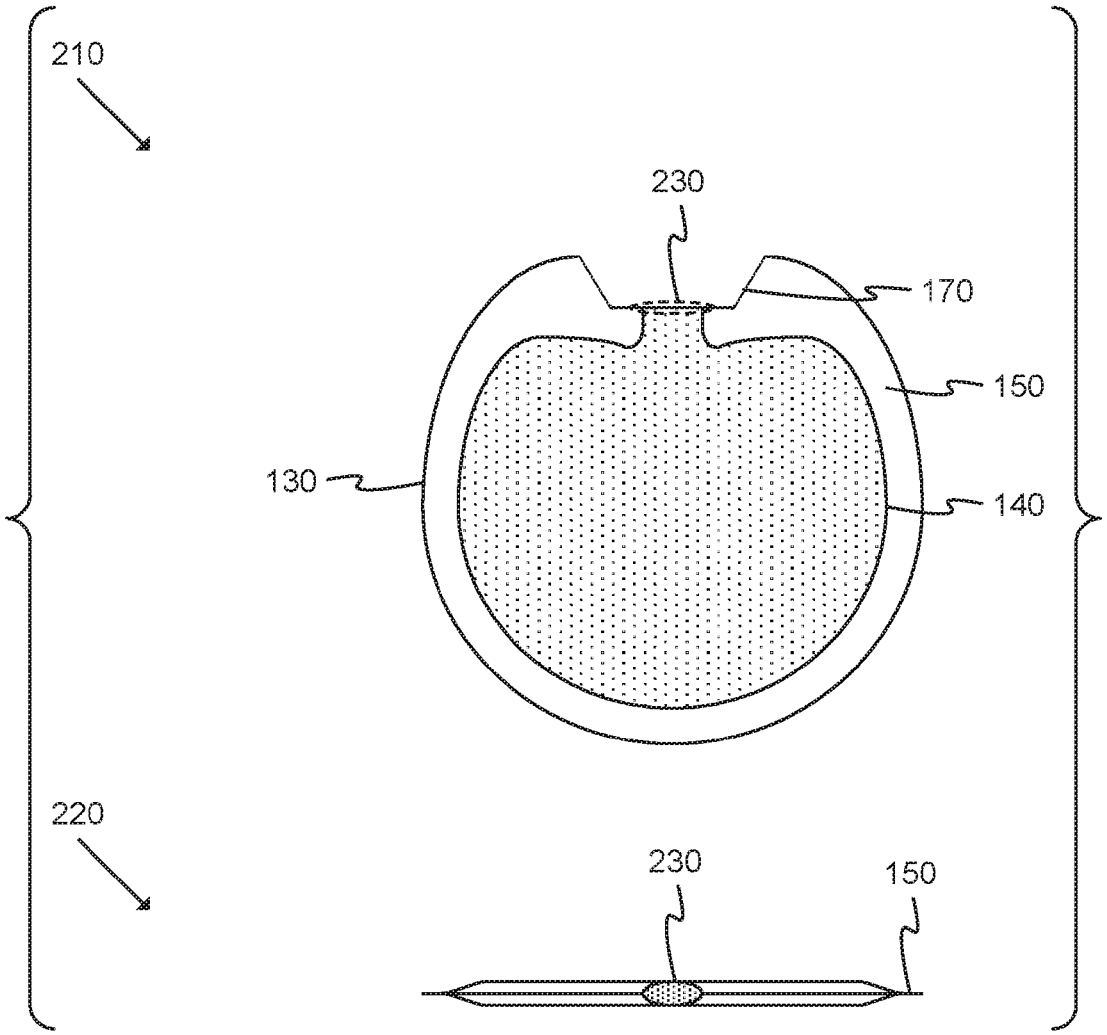
FIG. 2 illustrates a front view and a top view of the container of FIG. 1 after the container has been opened.

FIG. 2 illustrates a front view 210 and a top view 220 of container 130 after the container has been opened. Specifically, this figure shows an integrated applicator spout 230 provided by some embodiments. As shown, the container 130 has been opened by removing the opening tab formed by notches 170. Alternatively, the container 130 may be opened by partially removing the opening tab (e.g., by tearing along a first notch 170 such that the sealed edge 150 is removed from the area along the opening of the spout 230 but the opening tab may remain secured at the opposite notch 170).

As shown in top view 220 the opening of the applicator spout 230 may have a generally round shape defined by the thickness of the cavity 140 (e.g., one to two millimeters) and an appropriate width for the material to be applied (e.g., one-fourth inch). The integrated applicator 230 may be formed as shown by including a protruding area of the cavity 140. The protruding area may be generally rectangular-shaped when viewed from the front or back of the container as shown, thus forming a tube or cylinder extending out from the cavity 140 to the spout 230.

Although the integrated applicator of FIG. 2 has been described with reference to various specific details, one of ordinary skill in the art will recognize that different embodiments may be implemented in various different ways with various different specific details without departing from the spirit of the invention. In addition, the elements shown in FIG. 2 are conceptual in nature and not meant to convey specific dimensions, relative dimensions, shapes, sizes, etc. For instance, although some applicators may have a generally cylindrical shape other applicators may be shaped in various other appropriate ways (e.g., having a conical shape that narrows from the cavity to the spout, having a rectangular shape or other polygonal shape, etc.).

Figure 3:
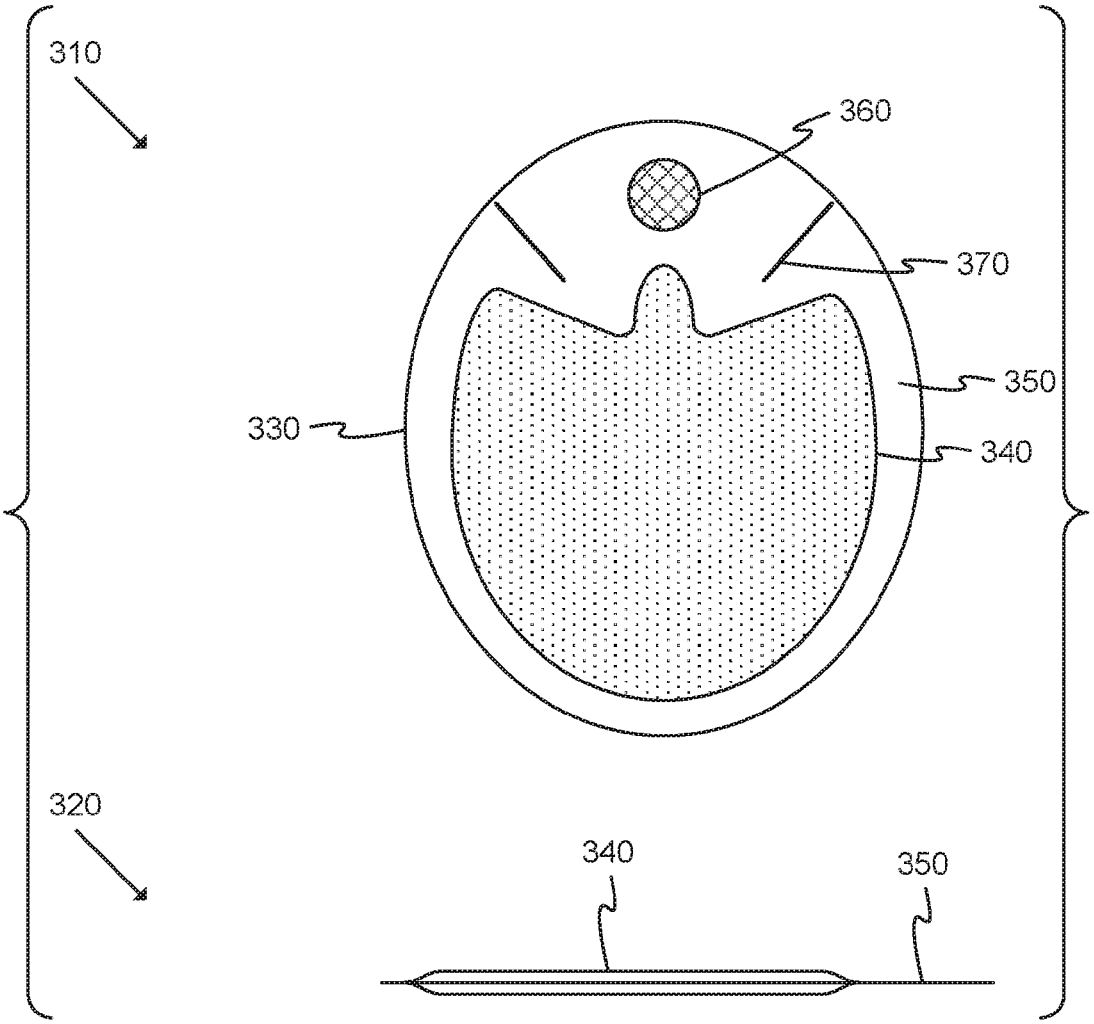
FIG. 3 illustrates a front view and a side view of an alternative container according to an exemplary embodiment of the invention.

FIG. 3 illustrates a front view 310 and a side view 320 of an alternative container 330 according to an exemplary embodiment of the invention. Specifically, this figure shows the various features included in some embodiments of the alternative container. As shown, the container 330 may include a cavity 340 adapted to store lotion, a sealed edge 350, a fastener receptacle 360, and a set of notches 370 that may define a removable (or partially removable) section of the container 330 that forms an opening feature.

The various features of container 330 may be similar to those described above in reference to container 130. As shown, container 330 may have an oval shape when viewed from the front and may include a removable section defined by notches 370, where the removable section does not extend out from the body of the container 330 (as opposed to the round tab-like removable section of container 130 that extends out from the generally round body of container 130).

Although the container of FIG. 3 has been described with reference to various specific details, one of ordinary skill in the art will recognize that different embodiments may be implemented in various different ways with various different specific details without departing from the spirit of the invention. In addition, the elements shown in FIG. 3 are conceptual in nature and not meant to convey specific dimensions, relative dimensions, shapes, sizes, etc. For instance, different embodiments may include removable sections of various sizes, shapes (e.g., rectangular, triangular, irregularly-shaped, etc.), etc.

In another alternative embodiment (not shown), a container may include a hollow cylindrical body having a removable top member, a base, and an elongate sidewall connecting the top and the base. The top may be a removable screw-on top having internal threads for complementary engagement with external threads formed on the outer surface of the top edge of the sidewall. The top may have female threading, and the sidewall may have male threading, or vice-versa. Alternatively, the top may be a snap-on top or removably attached using other suitable features, such as being pivotally attached via a hinge member connected at the top edge of the sidewall.

A loop member may be formed on the upper surface of the top of the container (and/or other appropriate location) to receive an attachment member, such as a hook clip. Alternatively, the attachment member may be a spring clip, snap hook or other appropriate type of attachment feature.

The container may have a length of approximately two to three inches, and a width (diameter of base end) of about three-fourths to one inch. As such, the container may have a volume of about 0.5 to 1.3 fluid ounces, and may hold an amount of sun protectant necessary for about one application to a user's body, particularly the face, neck and forearms as they are typically the parts most sensitive to sun rays and usually burn first.

The container may be sized to easily fit within a shirt or pants pocket. The container may be made of plastic and/or other suitable materials.

The container may be reusable. After a container has been emptied of sun protectant, the user may refill the container, by removing the top of the container, tearing open a refill packet (e.g., a rectangular foil packet), and pouring the contents of the refill package into the container. Such a refill packet may have a length of about two to three inches, and a width of about three-fourths to one inch. Alternatively, the container may be refilled from a larger container of lotion or be disposed of after initial use.

In some embodiments, the container may be sold or distributed initially empty, and an unopened refill packet may be placed within the container, to be stored and carried therein. The unopened refill packet may be stored and carried in the container until sun protectant is needed, at which time the user may open the container, remove and open the refill package to apply the sun protectant therein. As such, the container would not have to be waterproof in order to be used in water environments, because the unopened package would prevent water from penetrating to the sun protectant.

The various containers described above may be easily attached to a variety of apparel, equipment and accessories relating to outdoor activities, such as wet suits, surfer suits, scuba suits, ski jackets, motorcycling jackets, sailing jackets, bicycle handle bars, cycling accessories, golf bags, tennis bags, head wear, fishing tackle boxes, ATV gear bags, backpacks, horseback saddles, strollers, purses and key chains. Each container may be easily attached to the apparel, equipment or accessory by clipping the hook clip (or other appropriate fastener) to the desired apparel, equipment or accessory. As such, the container may be carried around at all times while the user is engaged a particular outdoor activity, such as surfing, swimming, fishing, skiing, jogging and the like.

If an unexpected need for sun protectant arises at any time during the outdoor activity, the user can open the container, and apply the sun protectant to the desired area of the body. This application can protect the user for the remaining duration of the outdoor activity until it is convenient for the user to access a larger supply of sun protectant. For example, the container may be attached to a jacket (e.g., a ski jacket) by passing a ball chain through a retention element and securing the chain to one of any number of secure loops, straps, zippers or button holes typically on such a jacket. As such, the container may be easily carried around at all times the user is wearing (or carrying) the jacket, even when the sun is not out.

Each container may provide a convenient emergency single use supply of sun protectant for when an unexpected need for sun protectant arises, such as when weather conditions change while a person is engaged in an outdoor activity, or when a person simply forgets to bring a conventional container of sun protectant. Also, the container may be convenient for the user to carry at all times while engaged in an outdoor activity, such as surfing, sailing, skiing, where would not be convenient to carry a conventional container.

The user can easily attach the container to apparel or equipment, and leave it there to be carried around at all times until needed for use. As such, the user has a supply of sun protectant even without a conventional large container of sun protectant.

Figure 4:
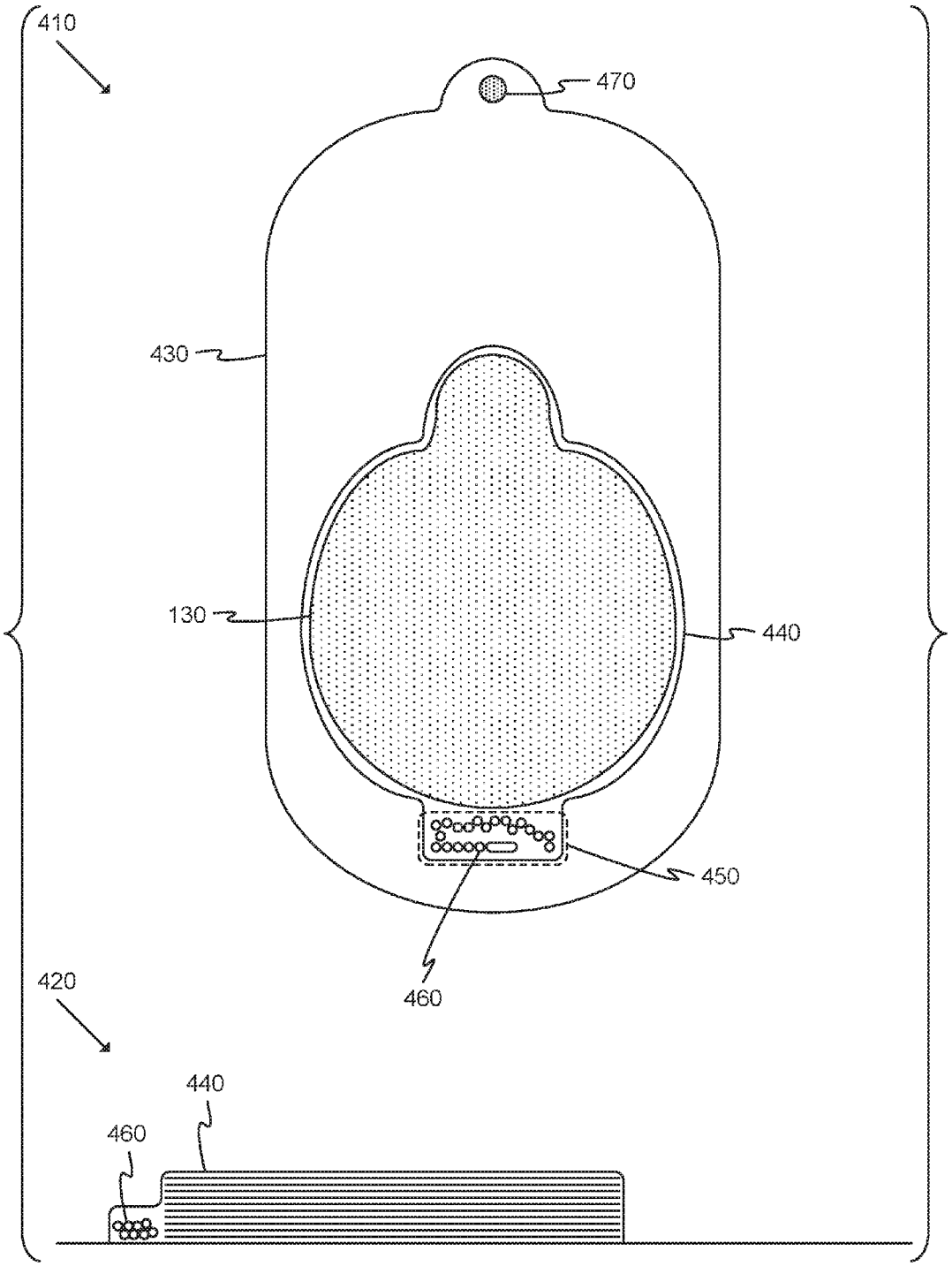
FIG. 4 illustrates a front view and a side view of a multi-unit kit according to an exemplary embodiment of the invention.

FIG. 4 illustrates a front view 410 and a side view 420 of a multi-unit kit 430 according to an exemplary embodiment of the invention. Specifically, this figure shows a multi-unit kit that is adapted to hold multiple containers 130. As shown, the kit 430 may include a storage cavity 440 that is shaped similar to the container 130 and sized such that multiple containers 130 may be stacked on top of each other. As shown, the cavity 440 may include a storage area 450 that may be adapted to hold a fastener 460 (e.g., a ball chain and clasp fastener). In addition, the kit 430 may include a through-hole 470 for hanging the kit on an appropriate element for display to consumers. In this example, the kit is adapted to hold ten individual containers. Different embodiments may be adapted to hold different numbers of individual containers (and/or differently shaped or sized containers, as appropriate).

The kit 430 may include a cardboard backing element that forms the body of the kit in some embodiments. The backing element may include product information, instructions, ingredients, graphic elements, and/or other appropriate elements. The cavity may be formed by, for instance, a clear plastic clamshell that extends out from the face of the backing element as shown. In this way, a potential user may be able to view the contents of the kit (e.g., the face of the container 130, the fastener 470, etc.) and the contents may be held in place.

Some embodiments may provide a kit (not shown) that has a package holding the refillable container of some embodiments and multiple refill packets. Such a kit may include three refill packages (or any other appropriate number of refill packets). The kit may include a back panel and a front panel that covers the container and refill packages. The front panel may be attached to the back panel, thereby holding the container and refill packages in place. The front panel may be attached to the back panel by an adhesive or other attachment way such as by using staples. Alternatively, the back panel and front panel can be integrally formed as one piece, such as by injection molding. The kit provides a way to sell and/or distribute the container and refill packages to users. The front panel may be transparent so that the container and refill packages are visible to potential users of the kit.

Although the kit of FIG. 4 has been described with reference to various specific details, one of ordinary skill in the art will recognize that different embodiments may be implemented in various different ways with various different specific details without departing from the spirit of the invention. In addition, the elements shown in FIG. 4 are conceptual in nature and not meant to convey specific dimensions, relative dimensions, shapes, sizes, etc. For instance, the size and shape of the cavity may be varied to accommodate various different sizes and shapes (and/or numbers) of containers.

It should be understood, of course, that the foregoing relates to illustrative details of exemplary embodiments of the invention and that modifications may be made without departing from the spirit and scope of the invention as defined by the following claims.

I claim:

1. A container adapted to store and dispense lotion, the container comprising:

a cavity that stores an amount of lotion sufficient for a single application;

an integrated applicator spout extending out from the cavity; and a removable section that allows stored lotion to be dispensed through the applicator spout if the removable section is separated from the container, wherein:

the removable section comprises a fastener receptacle that is able to accept a loop fastener, the removable section is defined by a pair of linear notches that are slanted with respect to a longitudinal axis, at least a portion of the removable section passes through the applicator spout, the pair of linear notches allows the integrated applicator spout to be exposed when the removable section is removed and when the removable section is partially removed, and the integrated applicator spout and the fastener receptacle are located along the longitudinal axis wherein the longitudinal axis is perpendicular to a latitudinal axis, the latitudinal axis passing between the pair of linear notches.

2. The container of claim 1, wherein the cavity has a round shape and the applicator spout forms a cylinder extending out from the cavity.

3. The container of claim 1, wherein the cavity stores sun protectant lotion.

4. The container of claim 1, wherein the removable section forms a round opening tab that extends out from the container.

5. A lotion kit comprising:

a plurality of single-use lotion containers, each single-use lotion container comprising:

two foil layers;

an adhesive-sealed outer edge formed by the two foil layers that defines a cavity able to store an amount of lotion sufficient for a single application;

an integrated applicator spout extending out from the cavity;

a removable section defined by a pair of linear notches that are slanted with respect to a longitudinal axis, wherein:

at least a portion of the removable section passes through the applicator spout, and the pair of linear notches allows the integrated applicator spout to be exposed when the removable section is removed and when the removable section is partially removed; and a fastener receptacle that passes through a section of the adhesive-sealed outer edge, wherein the integrated applicator spout and the fastener receptacle are located along the longitudinal axis wherein the longitudinal axis is perpendicular to a latitudinal axis, the latitudinal axis passing between the pair of linear notches; and a fastener able to be coupled to the plurality of single-use lotion containers via the fastener receptacle of each of the plurality of single-use lotion containers.

6. The lotion kit of claim 5, wherein each single-use lotion container from the plurality of single-use lotion containers stores sun protectant lotion.

7. The lotion kit of claim 5, wherein the fastener comprises a ball chain and clasp.

8. The lotion kit of claim 5, wherein the receptacle comprises a through-hole adapted to be coupled to the fastener.

9. The lotion kit of claim 5 further comprising a clear cavity adapted to display at least one single-use lotion container from the plurality of single-use lotion containers.

10. A multi-unit kit comprising:

a plurality of single-use containers, each single-use container from the plurality of single-use containers comprising:

a cavity that stores an amount of lotion sufficient for a single application;

an integrated applicator spout extending out from the cavity; and a removable section that allows stored lotion to be dispensed through the applicator spout if the removable section is separated from the container, wherein:

the removable section comprises a fastener receptacle that is able to accept a loop fastener, the removable section is defined by a pair of linear notches that are slanted with respect to a longitudinal axis, at least a portion of the removable section passes through the applicator spout, the pair of linear notches allows the integrated applicator spout to be exposed when the removable section is removed and when the removable section is partially removed, and the integrated applicator spout and the fastener receptacle are located along the longitudinal axis wherein the longitudinal axis is perpendicular to a latitudinal axis, the latitudinal axis passing between the pair of linear notches;

a fastener receptacle;

a fastener;

a backing element; and a clamshell that extends out from a face of the backing element, wherein the backing element and the clamshell provide a storage cavity that houses the plurality of single-use lotion containers, and wherein the storage cavity comprises a storage area that houses the fastener.

11. The multi-unit kit of claim 10 wherein the fastener is one of a ball chain and clasp, a clip, a cord, a chain, and a hook and wherein the fastener receptacle comprises a through-hole.

12. The multi-unit kit of claim 10, wherein each single-use container stores sun protectant lotion.

* * * * *